US006343628B2

(12) United States Patent
Reinecke

(10) Patent No.: US 6,343,628 B2
(45) Date of Patent: Feb. 5, 2002

(54) MACHINE FOR FILLING BOTTLES WITH LIQUID

(75) Inventor: Günter Reinecke, Solingen (DE)

(73) Assignee: Sig Hamba Filltec GmbH & Co. KG, Neunkirchen/Saar (DE)

( * ) Notice: Subject to any disclaimer, the term of this patent is extended or adjusted under 35 U.S.C. 154(b) by 0 days.

(21) Appl. No.: 09/798,887

(22) Filed: Mar. 2, 2001

(30) Foreign Application Priority Data

Mar. 3, 2000 (DE) ..... 100 10 145

(51) Int. Cl.[7] ..... B65B 43/42; B67C 3/00

(52) U.S. Cl. ..... 141/165; 141/129; 141/168; 141/172; 141/185; 141/190; 198/470.1; 198/474.1; 198/476.1; 53/300

(58) Field of Search ..... 141/129, 131, 141/134, 155, 163, 165, 167, 168, 172, 176, 183, 185, 190; 198/626.5, 626.6, 817, 470.1, 474.1, 476.1; 53/285, 287, 300

(56) References Cited

U.S. PATENT DOCUMENTS 4,802,571 A * 2/1989 Born et al. ..... 198/627
6,109,426 A * 8/2000 Messer, III ..... 198/817
6,209,710 B1 * 4/2001 Mueller et al. ..... 198/470.1

FOREIGN PATENT DOCUMENTS

| | | |
|---|---|---|
| DE | 25 09 611 | 9/1976 |
| DE | 29 22 308 | 12/1979 |
| DE | 196 42 987 | 4/1998 |

* cited by examiner

*Primary Examiner*—Timothy L. Maust
(74) *Attorney, Agent, or Firm*—Hernert Dubno; Andrew Wilford

(57) ABSTRACT

A bottling apparatus has a frame and an endless conveyor element on the frame, having a horizontal working stretch extending in a transport direction through a filling station, and carrying a plurality of holder plates each formed with a row of seats adapted to fit snugly around necks of bottles. Couplings releasably secure the holder plates to the conveyor element with the holder plates spaced in the transport direction along the working stretch and the rows extending transverse to the transport direction. A drive advances the conveyor element stepwise in the transport direction in the working stretch and arrests each of the holder plates in the filling station with the bottles in its seats aligned with the fill tubes. A plurality of stationary upright fill tubes in the filling station above the working stretch are aligned with the seats of the holder plate in the filling station. The plates are lifted in the filling station off the conveyor element to engage the fill tubes down into the respective bottles.

16 Claims, 7 Drawing Sheets

V 92
98
85
96
95
89
97
93
41
P
90
99
94
63
62
88
87
64
86
K
69
65
V 92
95
50
63
93
99
94
98
P
62
41
91
57
B
73
85
60
89
70
61
K
71
86
87
88
67
100
66

MACHINE FOR FILLING BOTTLES WITH LIQUID

SPECIFICATION

1. Field of the Invention

The present invention relates to a system for filling containers with liquid or viscous materials. More particularly this invention concerns a machine for filling bottles with milk, juice, soda, or the like.

2. Background of the Invention

In order to fill containers such as bottles with liquids such as juice or dairy products of highly liquid or somewhat viscous consistency it is known to use a machine such as described in German patent document 196 42 987 of P. Gustafsson and P. Fontanazzi. The bottles are held in basket-like seats in holders that are mounted on a chain that is passed through various machines that sterilize, fill, seal, and cap the bottles. The filling machine has a nozzle that aligns vertically with the bottle mouths as they stop in the filling station to squirt a quantity of the liquid down into the stationary bottles sitting underneath the nozzles in the seats of the holders.

Such a system is relatively effective with many liquids, in particular somewhat viscous ones. When used, however, with liquids like milk that tend to foam when agitated, they are ineffective, causing a body of foam to rise up in the bottles as they are filled, overflowing the tops and making it impossible to hygienically seal the containers.

Accordingly German patent document 2,922,308 of G. Haug and A. Zehnder describes a system where dip tubes are provided that are displaced down into a position with their lower ends near the bottoms of the bottles in the filling station, then as they are raised the liquid is emitted from the tube lower ends, resulting in smooth filling with minimal generation of foam. This arrangement is fairly difficult to control in that the telescoping dip tubes tend to leak and are hard to position perfectly. If the alignment of a bottle with the respective tube is not perfect, the liquid is spilled or the machine is shut down.

German patent document 2,509,611 of G. Hahn and T. Schneider describes an apparatus for filling small cups with liquid. Once the holder chain stops in the filling/capping station, the cups are raised out of the holder into engagement with the filling/capping device. While this system is relatively effective for short wide-mouth cups, it is not applicable to tall small-mouth bottles because of the difficulty of accurately aligning the small bottle mouths with the filling nozzles or tubes.

OBJECTS OF THE INVENTION

It is therefore an object of the present invention to provide an improved apparatus for filling bottles with liquid.

Another object is the provision of such an improved apparatus for filling bottles with liquid which overcomes the above-given disadvantages, that is which allows even tall small-mouth bottles to be filled with a highly foamable liquid with no significant chance of spillage or generation of foam.

SUMMARY OF THE INVENTION

A bottling apparatus has according to the invention a frame and an endless conveyor element on the frame, having a horizontal working stretch extending in a transport direction through a filling station, and carrying a plurality of holder plates each formed with a row of seats adapted to fit snugly around necks of bottles. Couplings releasably secure the holder plates to the conveyor element with the holder plates spaced in the transport direction along the working stretch and the rows extending transverse to the transport direction. Bottles are loaded into the seats upstream of the filling station with mouths of the bottles open upward and the bottles hanging by their necks from the holder plates and are removed from the seats downstream of the filling station. A drive advances the conveyor element stepwise in the transport direction in the working stretch and arrests each of the holder plates in the filling station with the bottles in its seats aligned with the fill tubes. A plurality of stationary upright fill tubes in the filling station above the working stretch are aligned with the seats of the holder plate in the filling station. The plates are lifted in the filling station off the conveyor element to engage the fill tubes down into the respective bottles so they can be filled through the tubes.

Thus with this system the bottles are held by their necks and are raised by the holders up to insert the fill tubes into them. In this manner it is possible even to align a relatively small bottle mouth perfectly with a filler tube and fill a relatively large bottle with liquid while generating no foam. The holders are lowered synchronously as liquid is introduced into the bottles to keep the liquid level at a constant position relative to the filler tubes. Such an arrangement can work with tall or short bottles easily with the same holder plates.

The conveyor element has in the working stretch an upper surface and the plates have in the working stretches lower surfaces resting on the conveyor element upper surface. The couplings each have according to the invention a vertically extending pin projecting from one of the surfaces and a coupling hole in the other of the surfaces receiving the respective pin. More particularly the pins project and taper upward from the upper conveyor-element surface and the coupling holes are formed in the plates. In addition the conveyor element is formed by a pair of horizontally spaced endless chains each having a succession of the pins. The plates are each transversely elongated and have ends each formed with a respective one of the coupling holes.

Each plate in accordance with the invention is formed by a pair of separable subplates each formed with a pair of transversely spaced coupling holes. Confronting edges of the subplates have cutouts together forming the seats, and the subplates are pivoted apart at upstream and downstream ends of the working stretch to allow bottles to be loaded in and taken out.

A stationary guide pin projecting downward in the filling station has a free lower end spaced immediately above the plate in the filling station in the lower position thereof. The plates are each formed with a vertically throughgoing guide hole aligned with the guide pin so that when the plate is raised from the lower position the guide pin fits into the respective guide hole. This prevents the plates from shifting horizontally after being lifted off the coupling pins on the conveyor element. To ensure smooth vertical movement of the plates as they are raised and lowered a hold-down element engages down against an upper face of the holder plate in the filling station and is raised with the plate on movement of same from the lower position to the upper position, normally clamping the plate against a raised guide-rail section as described below.

In accordance with the invention at least one horizontal guide rail extending along the working stretch through the filling station has an upper surface on which the holder plates slide as they advance in the direction. This rail has a low-friction upper surface engaging the holder plates in the working stretch. The guide rail further has in the filling station a section displaceable vertically relative to the rest of the rail. The lifting means is an actuator connected to the rail section. More particularly there are two such guide rails extending parallel to each other spaced apart transversely to the direction and each having a respective such section. A transverse beam extends between and is fixed to the two sections. The actuator includes an electric motor mounted on the frame, a single output shaft extending horizontally transverse to the direction and driven by the motor, and respective linear drives connected between ends of the shaft and ends of the transverse beam. The linear drives are each a chain or belt drive having an upper end connected to the end of the output shaft and a chain or belt connected to the respective end of the transverse beam.

To prevent overly fast movement of the bottles, especially when they are full, a damping element connected to the frame and to the beam damps vertical movement of the beam. This damping element is a pneumatic cylinder.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
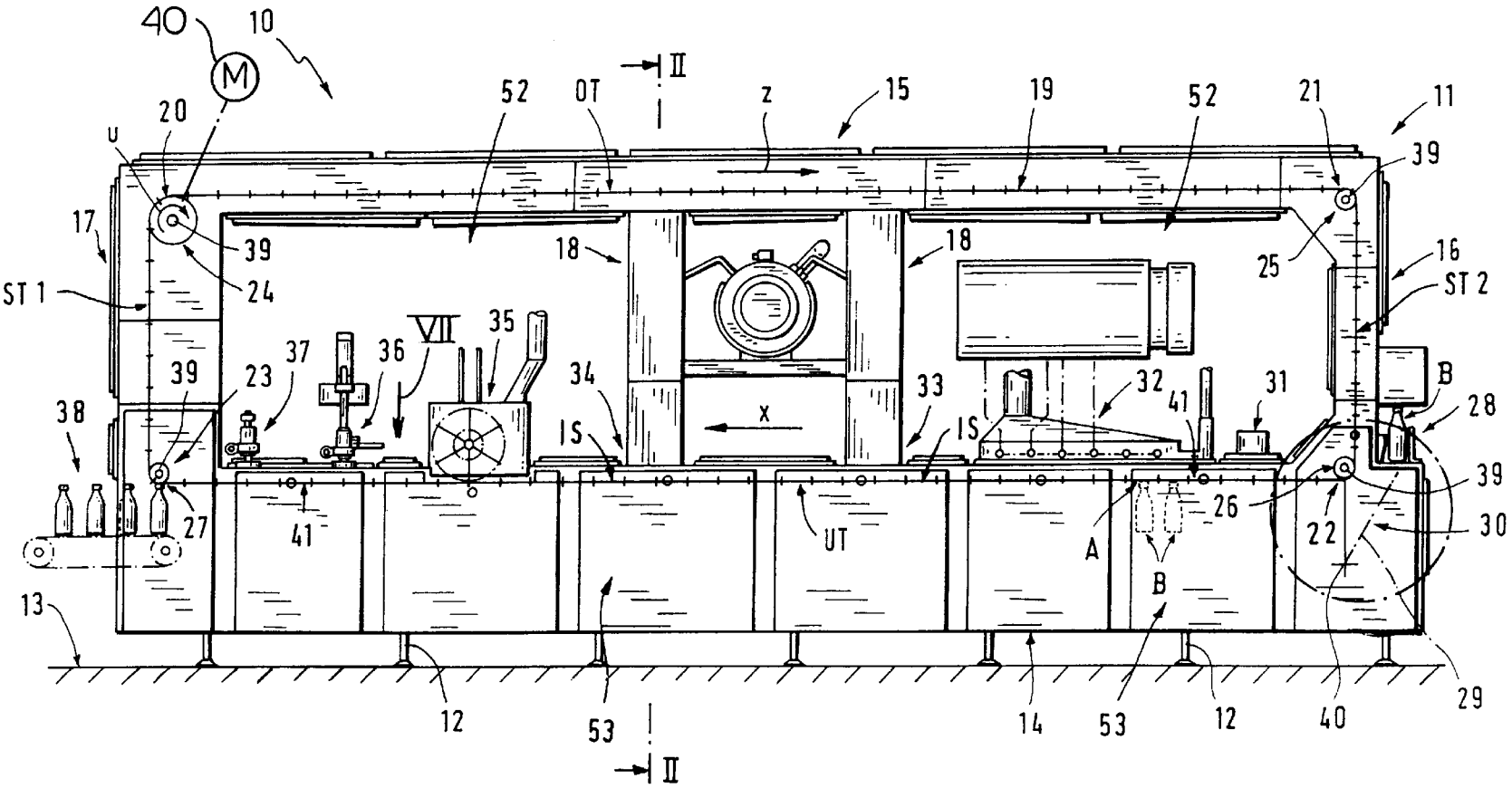
FIG. 1 is a small-scale and partly diagrammatic side view of the apparatus according to the invention.

As seen in FIG. 1 a bottling system 10 in accordance with the invention has an open frame 11 supported via feet 12 on the floor or ground 13 and having a horizontally extending lower portion 14, a parallel upper portion 15, and upstream and downstream end uprights 16 and 17 connecting the ends of the portions 14 and 15. Centrally a portal-type upright 18 supports the center of the upper portion 15.

An endless conveyor element 19 passes at upper corners 20 and 21 and lower corners 22 and 23 around respective wheels or rollers 24, 25, 26, and 27 carried on respective axles 39 and driven by a variable-speed servomotor motor 40 to rotate in a direction u (see corner 20) so that a straight and horizontal lower conveyor stretch UT moves in the lower frame portion 14 in a transport direction x and an upper straight and horizontal stretch OT moves oppositely in the upper portion 15 in a direction z. In addition the conveyor forms at its downstream end a vertical reach ST1 extending between the corners 23 and 24 and at its upstream end another vertical reach ST2 extending between the corners 21 and 22. The frame 11 defines between the upper portion 15 and upper reach OT on one side and the lower portion 14 and lower reach UT on the other side a space 52 and below the lower reach UT a space 53.

An intake station 28 at the lower upstream corner 22 has a loader 29 having a pivotal bottle holder 30 that fits PET containers or bottles B to the conveyor 19, whence they are moved in the transport direction x along the space 53 through a sensor machine 31 which determines if any bottles are missing, a sterilizing machine 32, a first filling machine 33, a second filling machine 34, a cap-cleaning and feeding machine 35, a cap-fitting machine 36, a cap-crimping machine 37, and an unloading machine 38 at the lower downstream corner 23. The filling machines 33 and 34 load respective basically liquid materials into the bottles B, e.g. crushed fruit and yoghurt, and may correspond to the system shown in U.S. Pat. No. 4,862,933. The unloading machine 38 is a simple conveyor on which the bottles B are set after being released from the conveyor 19 as described below. The machines 31, 32, 33, 34, 35, 36 37, and 38 are all accommodated centrally in the machine in the space 52.

The conveyor element 19 carries a series of holders 41 each formed a pair of plates 42 and 43 that have confronting edges at a joint T where they are each formed with ten semicircular cutouts 48 and 49 forming seats A aligned in columns S parallel to the direction x and rows R perpendicular thereto and centered on transverse lines L. The bottles B each have a neck H formed with a radially outwardly projecting rim 50 adapted to sit on the top faces of the plates 42 and 43, with a threaded portion 51 of each neck H extending upward from the conveyor 19. The plates 42 and 43 are mounted on the conveyor element 19 such that as the conveyor element 19 goes around the corners 22 and 23 each plate 42 will separate from the respective plate 43 to open up the seats A and allow bottles B to be loaded in and taken out by the respective machines 28 and 38.

Figure 2:
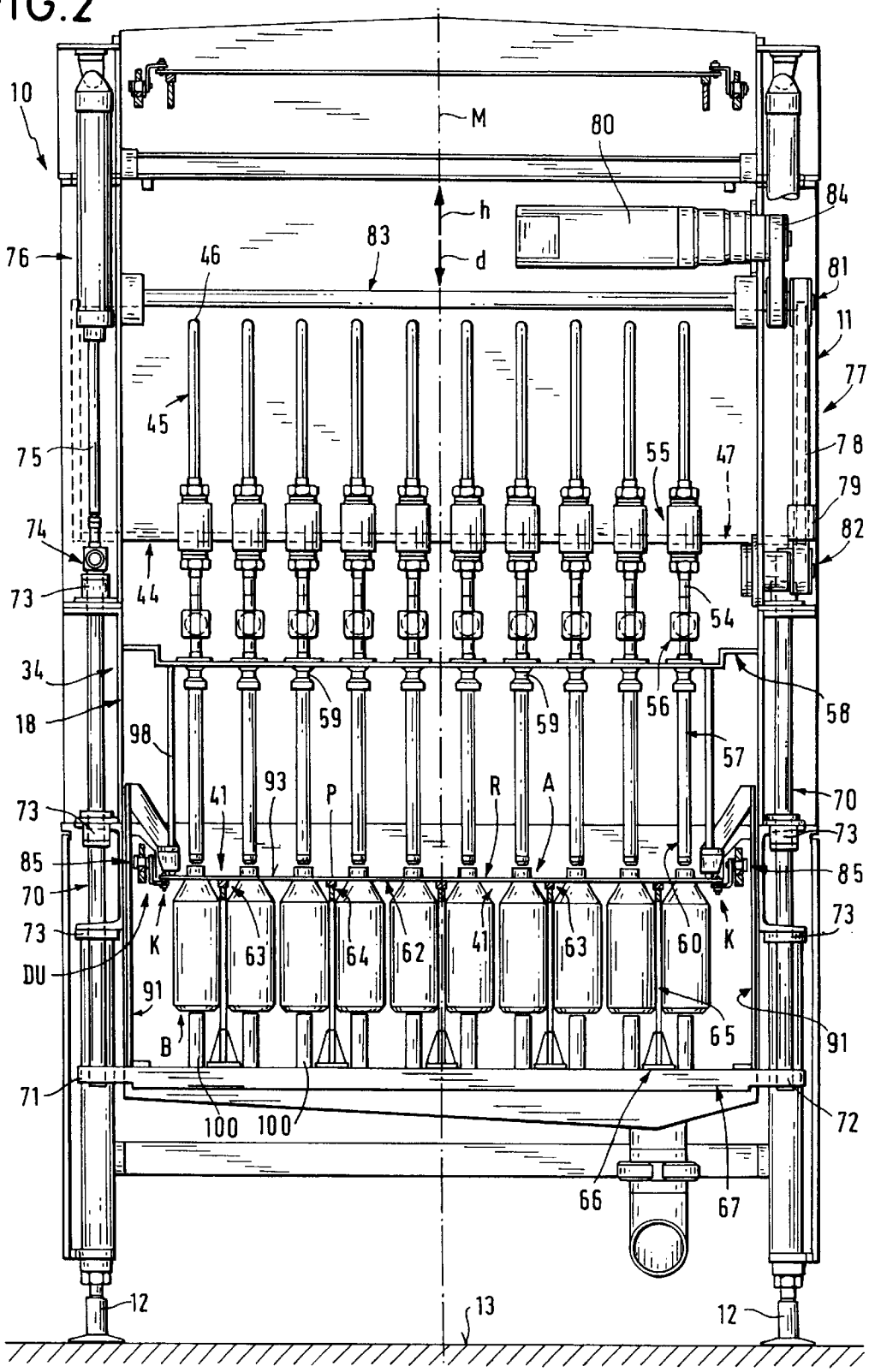
FIG. 2 is a larger-scale section taken along line II—II of FIG. 1.

The filling machine 34 shown in FIG. 2 has a reservoir 44 and ten inverted-U pipes 45 with upper ends 46 at an upper region of the reservoir 44 and unillustrated lower intake ends opening just above a floor 47 thereof. These pipes 45 feed through respective inductive flow meters 55 whose outputs 54 are connected to servovalves 56 to fill tubes 57 having upper ends 59 fixed in a bracket 58 fixed like the reservoir 44 on the frame 11. The fill tubes 57 are cylindrical and vertical and have lower ends 60 provided (see FIG. 6) with nozzles 61.

The plates 42 and 43 of each holder 41 are releasably held by mounts K on the conveyor element 19 as described below and ride via their lower surfaces 62 on surfaces 63 of low-friction plastic rails P carried on metal support bars 64. These bars 64 in turn are supported on posts 65 having lower ends or feet 66 supported on a transverse support beam 67 extending horizontally crosswise of the direction X.

Figure 5:
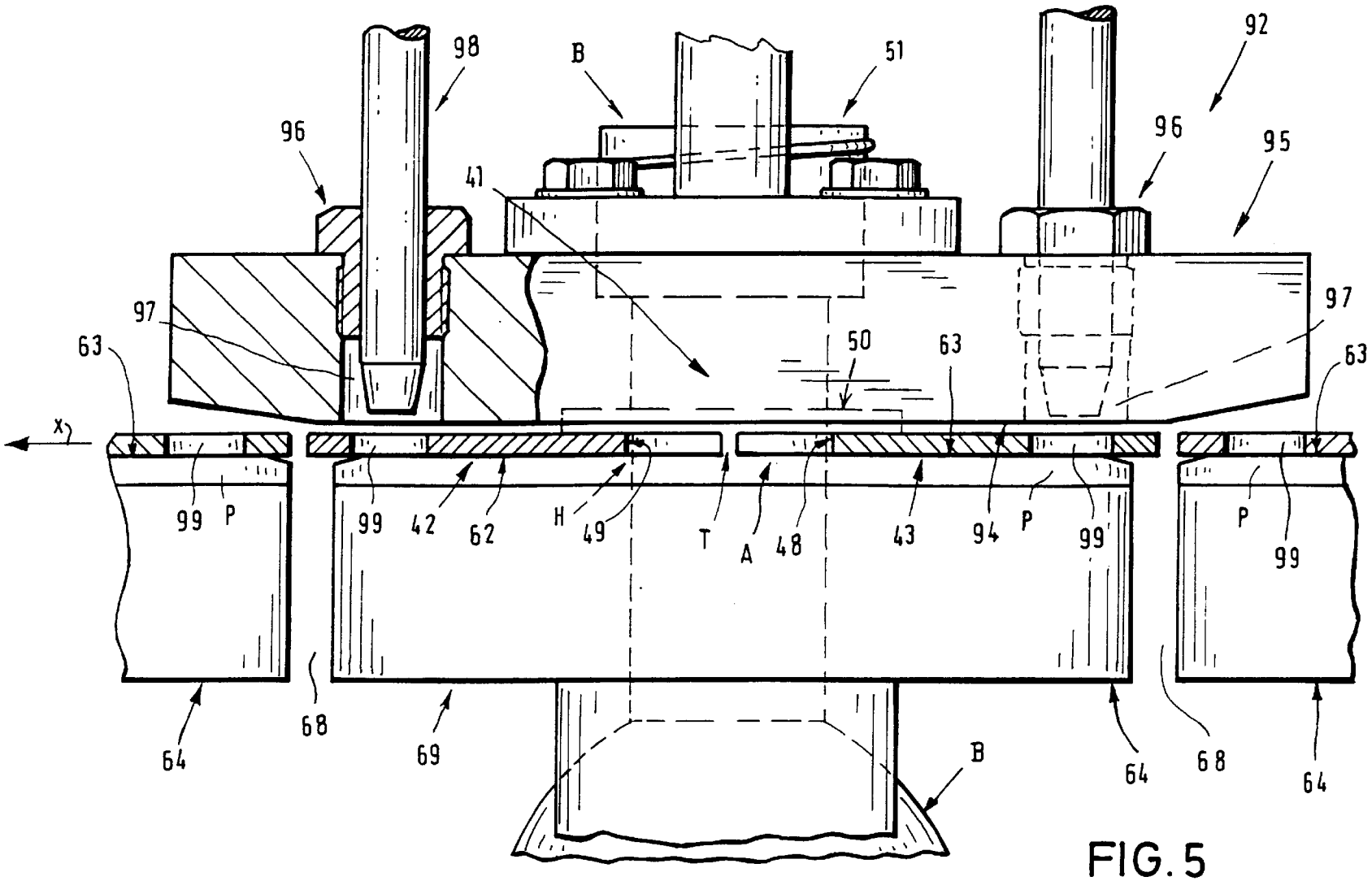
FIG. 5 is a section taken along line V—V of FIG. 4.

FIG. 5 shows how the rails 63 are interrupted at 68 to form underneath the filling machine 34 a section 69 whose support beams 67 have ends 71 and 72 (FIG. 2) carried on vertical tie rods 70 slidable in journals 73 on the frame 11. Each rod 70 has an upper end 74 attached to a lower end of a piston rod 75 of a double-acting pneumatic cylinder 76 serving mainly as a damper and to cancel out the weight of the transverse beam 67 and its load. In addition a reversible motor 80 has an output 84 connected to a shaft 83 extending parallel to the beams 67 and connected at each end to a belt drive 77 comprised of a belt 78 extending mainly vertically and passing at its upper end around a toothed pulley 81 carried on the shaft 83 and at its lower end around an idler wheel 82. Brackets 79 on each of the belts 78 are connected to the respective rods 70 so that the motor 80 can accurately raise and lower the section 69.

The conveyor element 19 comprises two standard link-type roller chains 85 riding at least in the lower stretch UT on horizontal guide rails 86 carrying at each plate 42 and 43 a bracket 87 having a horizontal leg 88 on which is mounted an upstanding and upwardly tapered pin 89 fitting through a hole 90 of a respective plate 42 or 43 and forming the above-mentioned releasable coupling K. At each end of each of the beams 67 of the section 69 is a vertical support bar 91 having an upper end provided with an arm 92 fitted on its lower end with an element 95 having a hold-down surface 94 bearing downward on upper faces 93 of the holders 41 in the section 69.

Figure 3:
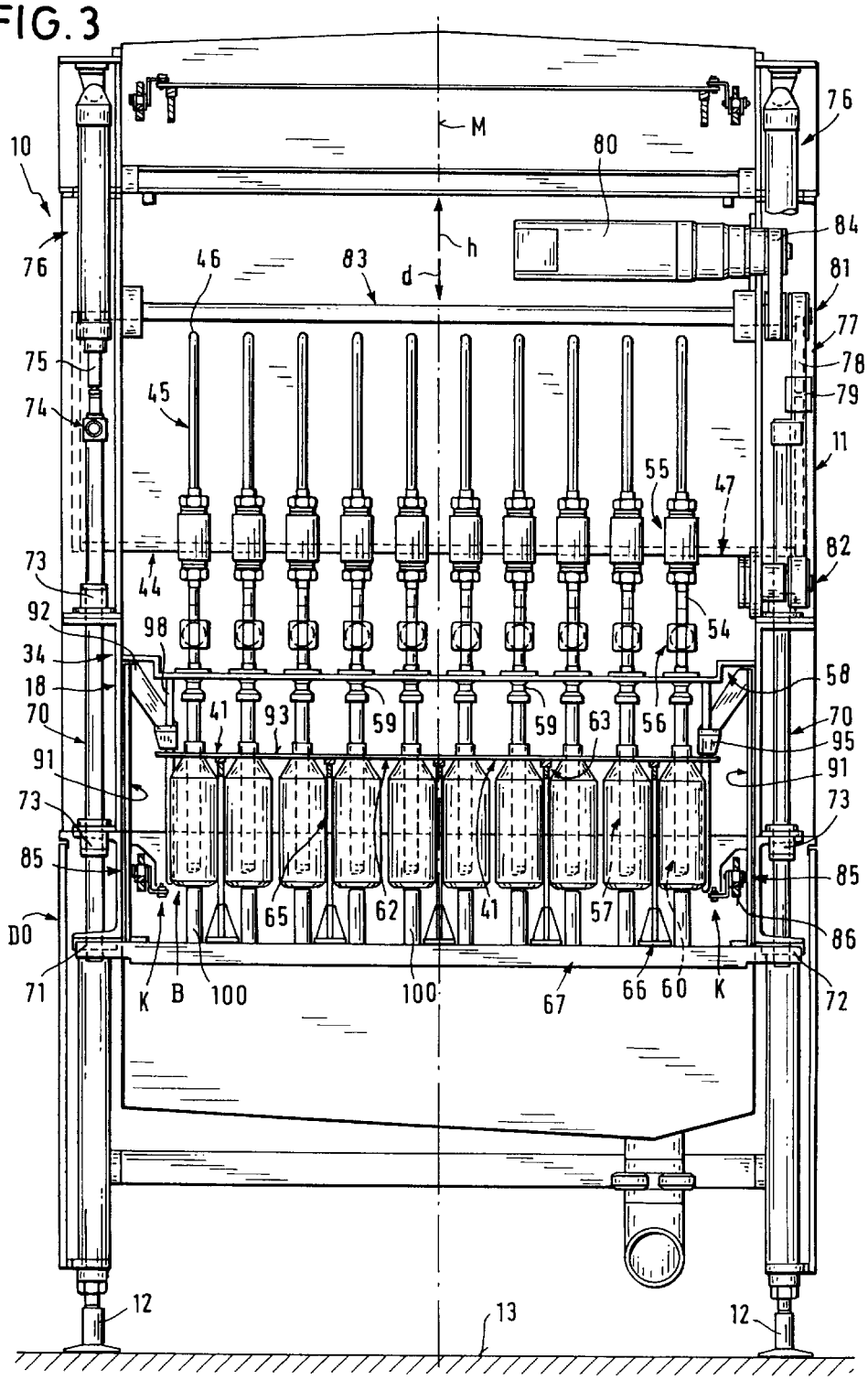
FIG. 3 is a view like FIG. 2 but showing the machine in another position.
Figure 4:
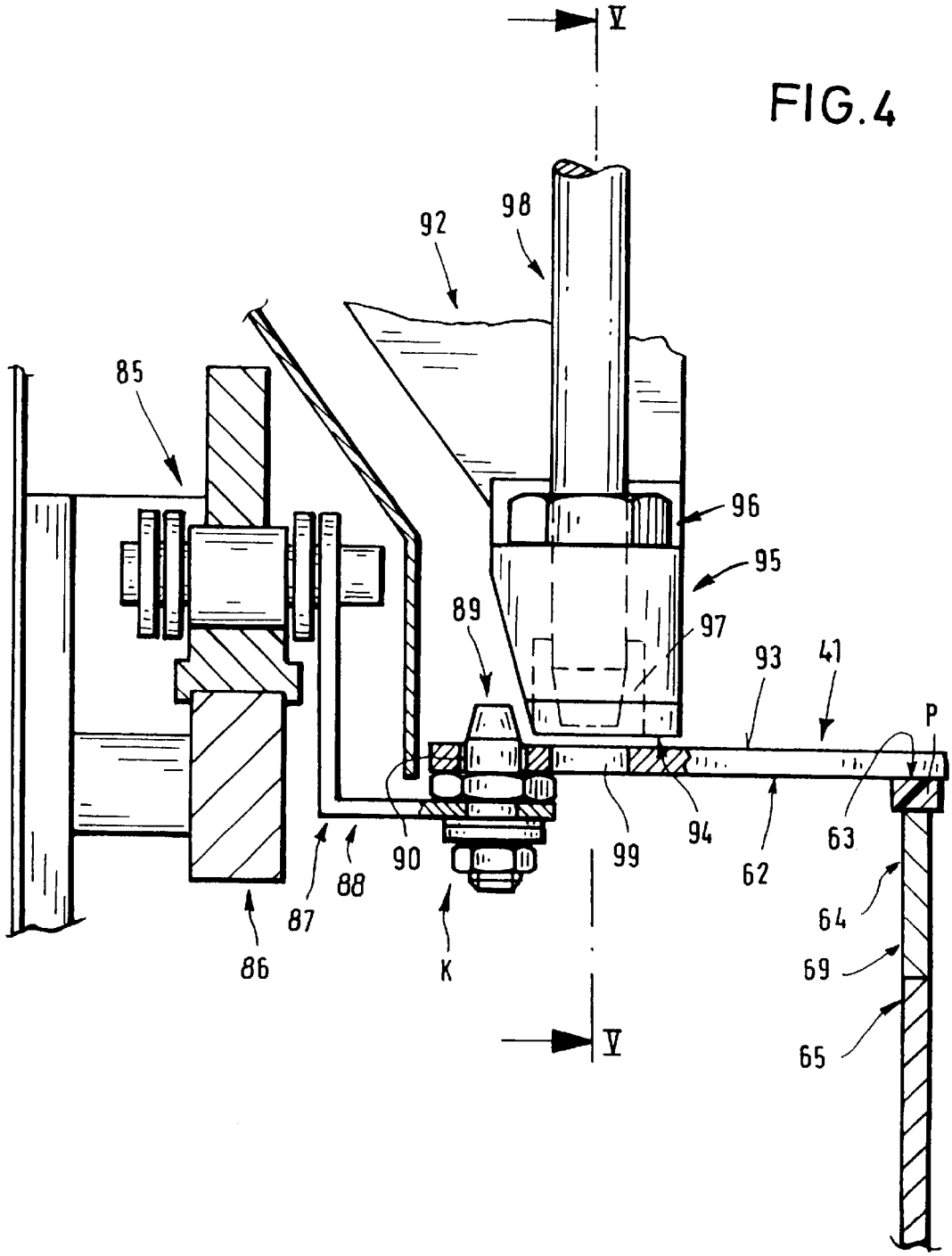
FIG. 4 is a large-scale view of the detail indicated at IV in FIG. 2.
Figure 6:
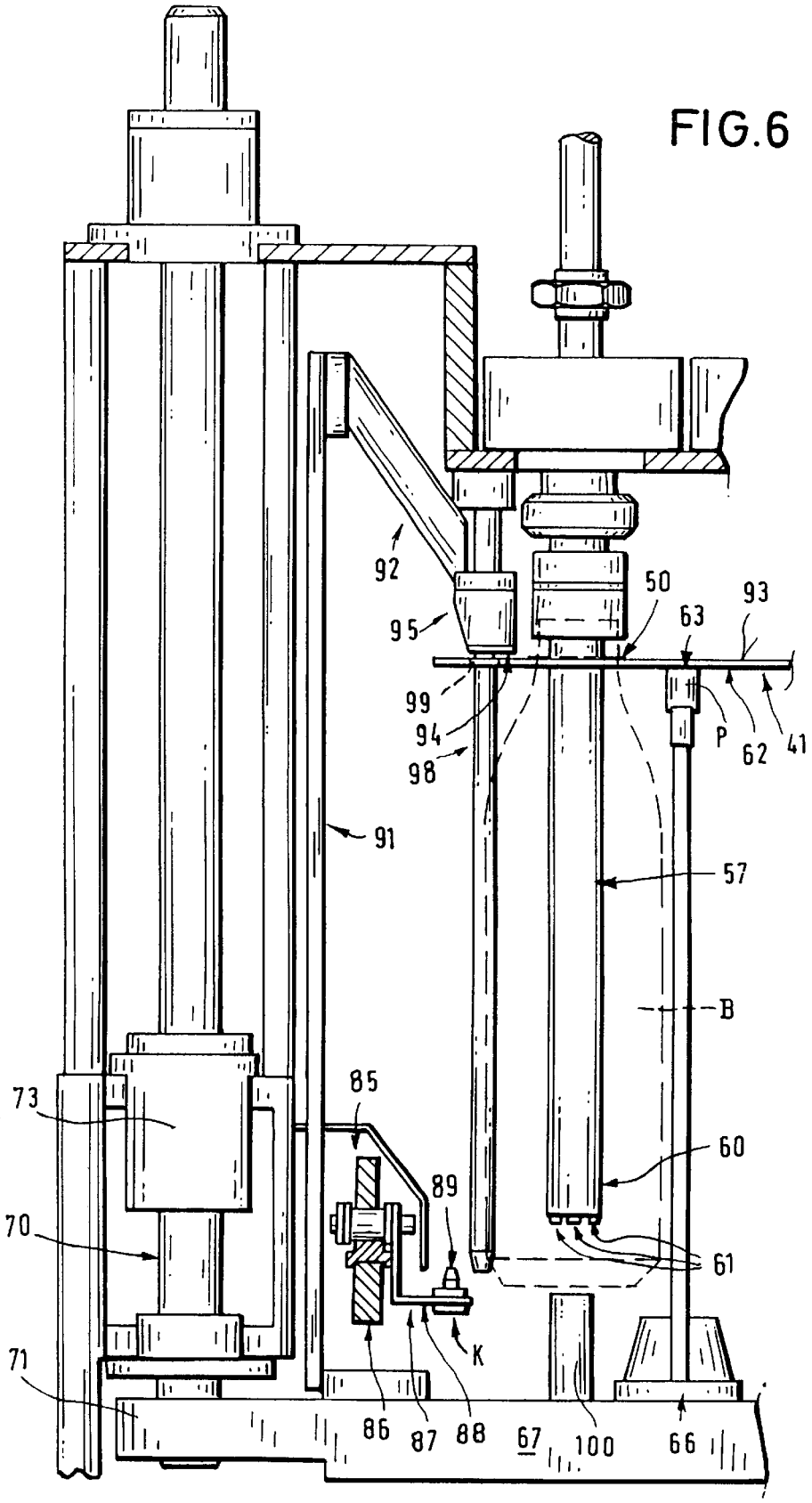
FIG. 6 is a large-scale view of the detail indicated at VI in FIG. 3.
Figure 7:
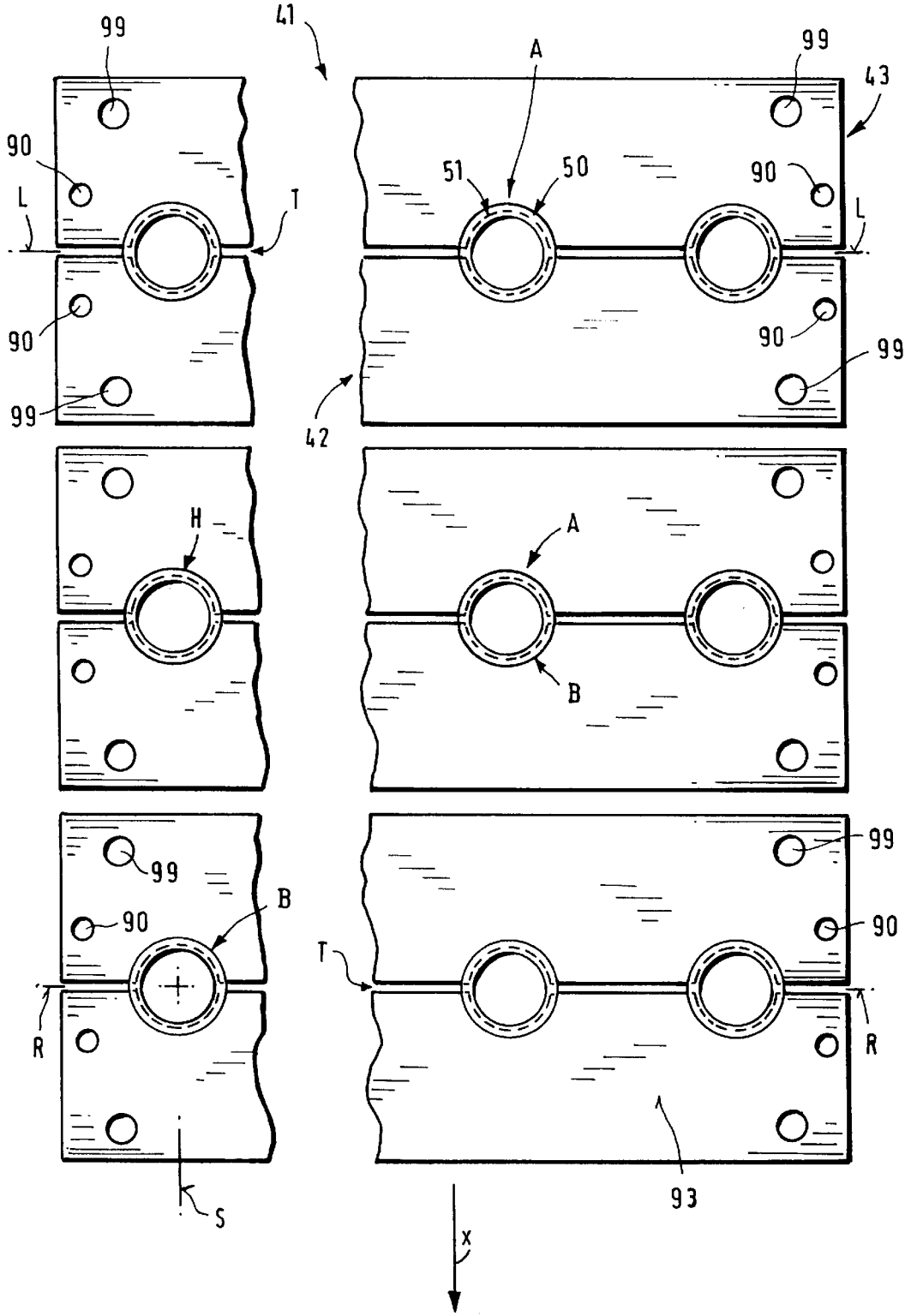
FIG. 7 is a top view taken in the direction of arrow VII of FIG. 1.

Vertically throughgoing holes 97 in the elements 95 are fitted with slide bushings 96 in which are engaged stationary vertical guide rods 98 whose lower ends are slightly above the holders 41 in the lower positions of FIGS. 2, 4, and 5, and which fit in the raised positions of FIGS. 3 and 6 through holes 99 in the plates 42 and 43. Upper ends of these rods 98 are fixed in the brackets 58.

As best seen in FIGS. 2 and 3 this system functions as follows:

The motor 40 advances the conveyor 19 in steps in each of which a row R of ten bottles B held by a holder 41 is positioned under each of the machines 32 through 37. According to the invention when the machine stops with such a row R of bottles B underneath the filling machine 33 or 34, the motor 80 is operated by a controller 101 to raise the traverse 67 in the section 69 as shown by arrow h. This action will cause the holder 41 to be picked up off the pins 89 while at the same time the rods 98 are fitted to the holes 99 to prevent horizontal shifting of the holder 41. The bottom face 62 of the holder 41 will remain in contact with the surface 63 of the raising rail 64 while the top surface 93 will remain in engagement with the bottom face 94 of the hold-down element 95, ensuring that the holder 41 is captured and guided with great accuracy. The traverse 67 is lifted until the fill tubes 47 extend to the bottom of the bottles 60 which can additionally be supported on blocks 100 on the traverse 67.

Once fully raised as shown in FIG. 3 the filling device 33 or 34 pumps liquid from the supply 44 down through the tubes 57 and out the nozzles 61 to fill the bottles B. As they fill, the motor 80 reverses to move the bottles down as shown by arrow d so that the liquid is introduced very gently into the bottles B, in such a manner as to completely eliminate foaming.

By the time the bottles B have been dropped all the way back down so that the holder 41 is sitting on the pins 89, the tubes 57 have pulled out of the tops of the bottles B, the bottles B are full, and the valves 56 have closed.

With this system the various drives and mechanical elements are all provided outside the central area to both sides of the middle M of the machine, so that this area can be continuously flooded with sterile air. There is no need to maintain sterility, for example, of the elements 70–99 that serve to move and lift the bottles, as these parts are outside the central clean area.

I claim:

1. A bottling apparatus comprising:

a frame;

an endless conveyor element on the frame and having a horizontal working stretch extending in a transport direction through a filling station;

a plurality of holder plates each formed with a row of seats adapted to fit snugly around necks of bottles;

couplings releasably securing the holder plates to the conveyor element with the holder plates spaced in the transport direction along the working stretch and the rows extending transverse to the transport direction;

means for loading bottles into the holder plates upstream of the filling station with mouths of the bottles open upward and the bottles hanging by their necks from the holder plates and for removing bottles from the holder plates downstream of the filling station;

drive means for advancing the conveyor element stepwise in the transport direction in the working stretch and for arresting each of the holder plates in the filling station with the bottles in its seats aligned with the fill tubes;

a plurality of stationary upright fill tubes in the filling station above the working stretch and aligned with the seats of the holder plate in the filling station;

lifting means in the filling station for raising the holder plate therein from a lower position resting on the conveyor element and with the coupling engaged to an upper position raised off the conveyor, with the coupling disengaged, and with the fill tubes engaged down into the respective bottles; and filling means connected to the tubes for emitting liquid from lower ends of the tubes when bottles in the station are raised by the lifting means.

2. The bottling apparatus defined in claim 1 wherein the conveyor element has in the working stretch an upper surface and the plates have in the working stretches lower surfaces resting on the conveyor element upper surface, the couplings each comprising a vertically extending pin projecting from one of the surfaces and a coupling hole in the other of the surfaces receiving the respective pin.

3. The bottling apparatus defined in claim 2 wherein the pins project and taper upward from the upper conveyor-element surface and the coupling holes are formed in the plates.

4. The bottling apparatus defined in claim 3 wherein the conveyor element is formed by a pair of horizontally spaced endless chains each having a succession of the pins, the plates each being transversely elongated and having ends each formed with a respective one of the coupling holes.

5. The bottling apparatus defined in claim 4 wherein each plate is formed by a pair of separable subplates each formed with a pair of transversely spaced coupling holes.

6. The bottling apparatus defined in claim 3, further comprising:

a stationary guide pin projecting downward in the filling station and having a free lower end spaced immediately above the plate in the filling station in the lower position thereof, the plates each being formed with a vertically through-going guide hole aligned with the guide pin, whereby when the plate is raised from the lower position the guide pin fits into the respective guide hole.

7. The bottling apparatus defined in claim 6, further comprising:

a hold-down element engageable down against an upper face of the holder plate in the filling station and raisable with the plate on movement of same from the lower position to the upper position.

8. The bottling apparatus defined in claim 1, further comprising:

at least one horizontal guide rail extending along the working stretch through the filling station and having an upper surface on which the holder plates slide as they advance in the direction.

9. The bottling apparatus defined in claim 8 wherein the rail has a low-friction upper surface engaging the holder plates in the working stretch.

10. The bottling apparatus defined in claim 8 wherein the guide rail has in the filling station a section displaceable vertically relative to the rest of the rail, the lifting means being an actuator connected to the rail section.

11. The bottling apparatus defined in claim 10 wherein there are two such guide rails extending parallel to each other spaced apart transversely to the direction and each having a respective such section, the lifting means including a transverse beam extending between and fixed to the two sections.

12. The bottling apparatus defined in claim 11 wherein the actuator includes an electric motor mounted on the frame;

a single output shaft extending horizontally transverse to the direction and driven by the motor; and respective linear drives connected between ends of the shaft and ends of the transverse beam.

13. The bottling apparatus defined in claim 12 wherein the linear drives are each a chain or belt drive having an upper end connected to the end of the output shaft and a belt or chain connected to the respective end of the transverse beam.

14. The bottling apparatus defined in claim 11, further comprising a damping element connected to the frame and to the beam for damping vertical movement of the beam.

15. The bottling apparatus defined in claim 14 wherein the damping element is a pneumatic cylinder.

16. The bottling apparatus defined in claim 1, further comprising sterilizing and capping machines on the frame flanking the filling means.

* * * * *